United States Patent [19]

Saito

[11] 4,298,973

[45] Nov. 3, 1981

[54] STRUCTURE FOR COUPLING BACK COVER WITH CASE BAND IN WRIST WATCH

[75] Inventor: Motoyuki Saito, Tanashi, Japan

[73] Assignee: Citizen Watch Co., Ltd., Tokyo, Japan

[21] Appl. No.: 218,703

[22] Filed: Dec. 22, 1980

[30] Foreign Application Priority Data

Dec. 26, 1979 [JP] Japan ..... 54-184679[U]

[51] Int. Cl.[3] ..... G04B 37/00

[52] U.S. Cl. ..... 368/276; 368/281; 368/309; 368/311; 368/88

[58] Field of Search ..... 368/309, 311, 276, 281, 368/88

[56] References Cited

U.S. PATENT DOCUMENTS

| | | | |
|---|---|---|---|
| 4,083,178 | 4/1978 | Sekiguchi et al. | 368/276 |
| 4,223,527 | 9/1980 | Tutiya et al. | 368/276 X |
| 4,257,118 | 3/1981 | Futaba et al. | 368/276 |

*Primary Examiner*—Ulysses Weldon

*Attorney, Agent, or Firm*—Bernard, Rothwell & Brown

[57] ABSTRACT

A structure for coupling a back cover with a case band in a wrist watch which comprises a case band having a long groove on the outer wall of a band attaching portion, a spring member being fitted in said long groove of the case band so as to outwardly project a protruded portion of said spring member and a part thereof being fixed to said case band, a back cover having a side wall with a long hole bored at the position corresponding to that of said spring member, and an elastic member for energizing and engaging said back cover with said case band along the axial direction thereof so as to cover a module. According to this structure, a compact, thin and highly waterproof wrist watch can be assembled, while disassembly thereof can be effected by merely pushing a portion of said spring member protruded from said long hole thereinto.

5 Claims, 6 Drawing Figures

STRUCTURE FOR COUPLING BACK COVER WITH CASE BAND IN WRIST WATCH

BACKGROUND OF THE INVENTION

1. Field of the Invention

This invention relates to a structure for coupling a back cover with a case band in wrist watches, and more particularly to an improvement of a structure for coupling a back cover with a case band in acoustic wrist watches of strange appearance.

2. Description of the Prior Art

In order to couple a back cover with a case band in acoustic wrist watches, various structures therefor have heretofore been proposed. In such type of acoustic wrist watch in which sound is created by vibrating a vibrating plate to which piezo-electric element is attached by means of piezo-electric effect, it is requested to maintain a wide effective area for the vibrating plate as much as possible in order to obtain a sufficient sound volume, so that the vibrating plate is generally provided on the bottom portion of the watch case. Accordingly such type of the wrist watch as mentioned above comes to a thick structure as a whole in the case when the back cover is coupled with the case band, and such wrist watch cannot satisfy recent requests for thinning, lightening, saving resources, and reducing cost of wrist watches. More specifically, a conventional structure is such that, as shown in FIG. 1, a stepped portion 1*a* is provided on the inner wall in the interior of an attaching portion for band of a case band 1, a vibrating plate 3 is supported on the stepped portion 1*a* through an O-ring 2 by an end portion of a back cover 4 on a part of which an acoustic sound hole 4*a* is bored and at the same time, the vibrating plate 3 is fitted to and engaged with the case band 1 by means of chamferring, so that a thick material must be subjected to machining and stamping because of a coupling structure of the back cover 4 with the case band 1, and therefore the conventional structure has a disadvantage of inferior workability. Furthermore a highly skilled working technique is required in the case where a fitting portion consisting of the back cover and the case band in a wrist watch has a strange profile and the back cover and the case band are chamferred in a prescribed fitting condition.

SUMMARY OF THE INVENTION

The present invention has been proposed to overcome such disadvantages as described above with respect to prior art.

It is a principal object of the invention to provide a structure for coupling a back cover with a case band in wrist or acoustic wrist watches being simple and thin in their structures, easy in working therefor, and favorable in their assembling.

The above and other objects and advantages of the invention will be fully understood by referring to the following description setting forth preferred embodiments of the present invention in connection with the attached drawings illustrating the embodiments.

DESCRIPTION OF THE PREFERRED EMBODIMENTS

Figure 1:
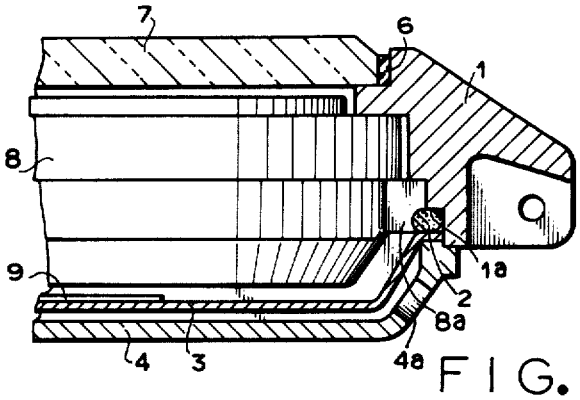
FIG. 1 PRIOR ART
FIG. 1 is a vertical sectional view showing a part of a conventional acoustic wrist watch case.
Figure 2:
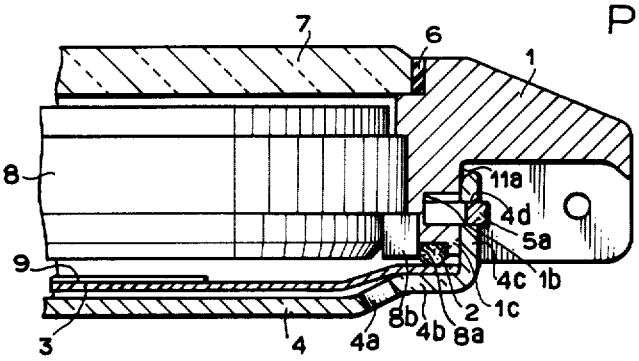
FIG. 2 is a vertical sectional view showing a part of one embodiment of an acoustic wrist watch case according to the present invention.
Figure 3:
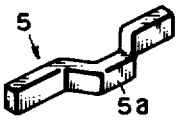
FIG. 3 is a perspective view showing an example of spring member according to the invention.
Figure 4:
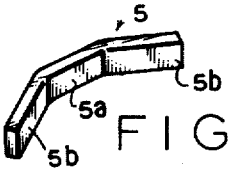
FIG. 4 is a perspective view showing another example of a spring member according to the invention.

The preferred embodiments of the present invention will be described hereinbelow by referring to the accompanying drawings. FIG. 2 is a vertical sectional view illustrating an acoustic wrist watch case in its attaching side of band in which a long groove 1*b* is bored on an outer wall 11*a* in the interior of the band attaching portion of a case band 1, and a spring member 5 is fitted in the long groove 1*b* and this spring member 5 is formed from a substantially convex leaf spring, a central portion 5*a* of which is outwardly projected, and one end of which is fixed to the case band 1 by means of spot welding. A covering glass 7 is pressed into and mounted onto an upper part of the case band 1 in its axial direction through a packing 6, whilst a stepped portion 1*c* is formed on the inner wall of a lower part of the case band 1 and a circumferential groove is formed by the stepped portion 1*c* and a stepped portion 8*a* of an auxiliary member 8*b* disposed on the outer end of a module 8, and an elastic member 2 is contained in the circumferential groove. Further an acoustically vibrating plate 3 is made from a thin plate of titanium, stainless steel and the like. A piezo-electric element 9 is attached to the upper surface of the vibrating plate 3, and the outer end of which is pressed onto the elastic member 2 by means of a rectangular bottom portion 4*b* of the back cover 4 being referred to hereinafter, whereby the vibrating plate 3 is supported. Moreover the back cover 4 is provided with a side wall 4*c* in which a long hole 4*d* is bored at the position opposed to that of the spring member 5, one end of which is fixed into the long groove 1*b* of the aforesaid case band, and an acoustic vibrating hole 4*a* as well as the rectangular bottom portion 4*b* for supporting the outer end of the acoustic vibrating plate 3 in the bottom part of the back cover. The back cover 4 engages with the case band 1 so as to cover the same from the ouside thereof, thereby to form a coupled structure. In this case, it is to be noted that the spring member 5 as shown in FIG. 3 may be replaced by the one shown in FIG. 4 and this spring member is formed into an arched shape, i.e., both end portions 5*b* of the member are protruded outwardly from its central portion 5*a*. In case of employing the latter spring member for coupling the back cover 4 with the case band 1, the central portion 5*a* of the spring member 5 is fixed in the long groove 1*b* and both the end portions 5 *b* are engaged with the long hole 4*d*, respectively.

In accordance with the above embodiment of the invention, the wrist watch is assembled by the manner as described hereinbelow.

First, the module 8 is contained in the interior of the case band 1, the outer end of the module 8 is supported by the auxiliary member 8*b*, and the elastic member 2 is disposed in the circumferential groove formed by the stepped portion 8*a* of the auxiliary member 8*b* and the stepped portion 1*c* of the aforesaid case band 1. Next, the acoustic vibrating plate 3 is installed in the watch case, and the side wall 4c of the back cover 4 is mounted on the outer wall 11a in the interior of the band attaching portion of the aforesaid case band 1 so as to cover the module 8 while pushing the central portion 5a of the spring member 5, one end of which is fixed in the long groove 1b of the aforesaid case band 1. The outer end surface of the acoustic vibrating plate 3 is pressed onto the elastic member 2 by means of the rectangular bottom portion 4b of the back cover 4 to support the vibrating plate 3, and the spring member 5 is pushed into the long hole 4d to engage the member with the upper side of the long hole 4d, so that assembly of the wrist watch is completed.

On the other hand, disassembly of the watch case can be effected by merely pushing a portion of the spring member 5 protruded from the long hole 4d thereinto, so that the case band 1 and the back cover 4 can easily be disassembled due to reaction force of the elastic member 2.

Figure 6:
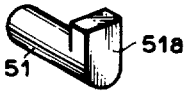
FIG. 6 is a perspective view showing a hook pin being employed in the wrist watch case of FIG. 5.
Figure 5:
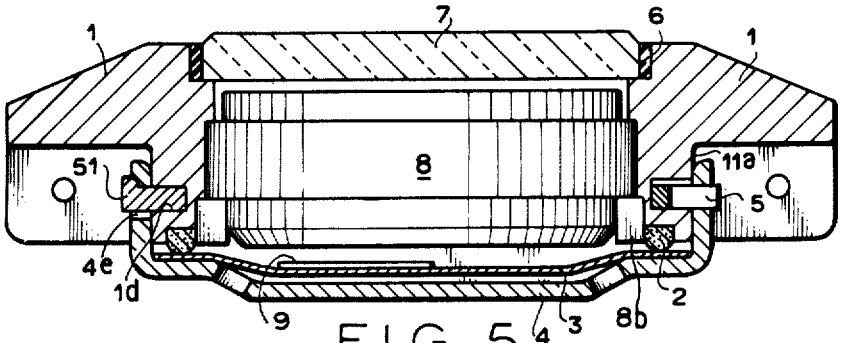
FIG. 5 is a vertical sectional view showing another embodiment of a wrist watch case in its attaching side of band according to the invention.

FIGS. 5 and 6 illustrate another embodiment in accordance with the invention in which FIG. 5 is a vertical sectional view showing a watch case in the band attaching side, and FIG. 6 is a perspective view showing a hook pin employed in the watch case of FIG. 5.

In FIG. 5, since the engagement of a case band 1 with a back cover 4 illustrated in the right side of the Figure is same as in that of the above first embodiment, the explanation therefor is omitted herein, and it is to be also noted that the reference numbers in the first embodiment designate the corresponding parts in the second embodiment, respectively. The engagement of the case band 1 with the back cover 4 appeared in the left side of FIG. 5 is as follows. That is, a blind hole 1d is formed on an outer wall 11a in the interior of a band attaching portion of the case band 1, the hook pin 51 shown in FIG. 6 is fitted into the blind hole 1d to fix the pin thereto, and a hooking portion 51a of the hook pin 51 is latched into an opening 4e of the back cover 4.

In the second embodiment according to the invention, the wrist watch is assembled by the following manner. First, a module 8, an elastic member 2, a vibrating plate 3 are successively installed in the watch case, next the hook pin 51 is latched into the opening 4e of the back cover 4, and thereafter a spring member 5 attached to the case band 1 in a portion appeared in the right side of FIG. 5 is engaged with a long hole 4d of the back cover 4 by similar manner to that of the fist embodiment, whereby assembly of the wrist watch is completed.

As described above, according to the present invention, a wrist watch is assembled by a case band for the case of an acoustic wrist watch provided with an acoustic vibrating plate 3, a back cover covering its structure for coupling the back cover from the outside of the case band, and a spring member made from a leaf spring material. Furthermore to be noted in the assembly according to the invention is that the acoustic vibrating plate is supported by the elastic member, and repulsive force is also obtained for coupling the back cover with the case band. As a result, it is attained by the structure according to the present invention to be high in its sealing property, easy in assembly, and lightened in thickness of the case band of wrist watch cases. Therefore a compact, thin and highly waterproof wrist watch can be manufactured in accordance with the invention.

Moreover since the invention relates to a structure in which a side wall of a back cover is coupled with the outside of a case band through a spring member, members obtained by forming a flat plate material by means of press working can be employed. Consequently a wrist watch case according to the invention is simple in working and can reduce its production cost.

Although the embodiments of the invention have been described in connection with an acoustic wrist watch case having a four-cornered shape, it is to be noted that similar advantages can also be attained when the invention is applied to wrist watch cases having strange appearances such as oval, almond and the like shapes.

While the present invention has been described with reference to particular embodiments thereof, it will be understood that numerous modifications may be made without departing from the spirit and scope of the invention.

What is claimed is:

1. A structure for coupling a back cover with a case band in a wrist watch comprising a case band having a long groove on the outer wall of a band attaching portion, a spring member being fitted in said long groove of the case band so as to outwardly project a protruded portion of said spring member and a part thereof being fixed to said case band, a back cover having a side wall with a long hole bored at the position corresponding to that of said spring member, and an elastic member for energizing and engaging said back cover with said case band along the axial direction thereof so as to cover a module.

2. A structure as claimed in claim 1 which further comprises an acoustic vibrating plate being sandwiched between said back cover, on the bottom of which an acoustic sound hole is further provided, and said case band in the axial direction thereof through said elastic member.

3. A structure as claimed in claim 1 wherein said spring member is a convex leaf spring, and one end of which being fixed to said case band by means of spot welding.

4. A structure as claimed in claim 1 wherein said spring member is a leaf spring having an arched shape, and the central portion of which being fixed to said case band by means of spot welding.

5. A structure as claimed in claim 1 wherein the engagement of said back cover with said case band in at least one side thereof is attained by a combination of a blind hole formed on the outer wall of said band attaching portion, a hook pin fitted in and fixed to said blind hole, and an opening into which said hook pin is latched by means of a hook portion of said hook pin.

* * * * *